US006837838B2

(12) United States Patent
List

(10) Patent No.: US 6,837,838 B2
(45) Date of Patent: Jan. 4, 2005

(54) EXERCISE DEVICE

(76) Inventor: Karl A. List, 4780 La Villa Marina, #J, Marina del Rey, CA (US) 90292

( * ) Notice: Subject to any disclaimer, the term of this patent is extended or adjusted under 35 U.S.C. 154(b) by 218 days.

(21) Appl. No.: 10/122,280

(22) Filed: Apr. 12, 2002

(65) Prior Publication Data

US 2002/0151417 A1 Oct. 17, 2002

Related U.S. Application Data

(63) Continuation-in-part of application No. 10/087,079, filed on Mar. 1, 2002, now Pat. No. 6,733,428.
(60) Provisional application No. 60/284,343, filed on Apr. 17, 2001.

(51) Int. Cl.[7] ..... A63B 21/00
(52) U.S. Cl. ..... 482/147; 482/146; 482/79
(58) Field of Search ..... 482/71, 51, 79, 482/130, 907, 146, 147, 52, 121, 126, 122

(56) References Cited

U.S. PATENT DOCUMENTS 3,664,666 A * 5/1972 Lloyd ..... 482/130
4,319,749 A * 3/1982 Agyagos
4,376,532 A * 3/1983 Hunstad
4,506,884 A * 3/1985 Hankin
5,643,162 A * 7/1997 Landers
5,879,275 A * 3/1999 Aruin ..... 482/146

OTHER PUBLICATIONS

"The Dancer's Companion, SRF Board, Manufactured by Fitter International Inc.", Photocopy of Catalog.

* cited by examiner

*Primary Examiner*—Jerome W. Donnelly
(74) *Attorney, Agent, or Firm*—Birch, Stewart, Kolasch & Birch LLP; Thomas M. Small

(57) ABSTRACT

An exercise device comprising two box-like open-sided platform sections disposed side-by-side in a closed, storage and transporting position or end-to-end in an open exercising position and having two rotary disk assemblies that are mountable in a plurality of fixed exercising positions along the platform sections by means of pins on the lower sides of the disk assemblies and a longitudinal series of mounting holes in each platform section. Elongated elastic resistance bands are connectable between the rotary disks, on hook connectors thereon, and between the disks and the platform sections, in various ways for closed-chain operation, when desired, or removable for open-chain exercises. A carrying handle and latches are provided in the platform sections, and U-shaped connectors are provided to join the platform sections together.

6 Claims, 6 Drawing Sheets

EXERCISE DEVICE

REFERENCE TO PRIOR APPLICATIONS

This application claims the benefit of copending provisional application No. 60/284,343, filed Apr. 17, 2001, and is a continuation-in-part of application Ser. No. 10/087,079, filed Mar. 1, 2002, now U.S. Pat. No. 6,733,428 entitled "Exercise Device.".

BACKGROUND OF THE INVENTION

This invention relates to exercise equipment and particularly to portable exercise devices that can be carried to selected locations and set up for use by an individual desiring to work out, typically on a supporting surface such as a floor. The invention relates more specifically to an exercise device having an elongated stationary base or platform and one or more rotary disk elements on the platform for supporting a portion of the body of the user while he or she rotates on the disk elements.

Numerous types of devices have been designed and constructed to assist individuals in fitness programs. These range from relatively complex, heavy and expensive devices such as universal gymnasium apparatus and exercise tables such as the Pilates "Reformer" and "Performer" to small step boxes, barbells and other weights, and various kinds of strength and flexibility building equipment. Some of this equipment is stationary and some is portable, and much of it is limited in use to one or a few specialized exercises.

One exercise device of the same general type as the present invention is sold by Fitter International, Inc., Calgary, Canada, under the trademark SRF Board and has a rotary disk that is mounted on a car or skate. The car is supported on an elongated track for back-and-forth movement against resistance provided by elastic bands, functionally similar to the Pilates Reformer, and a second rotary disk on a fixed base that can be positioned on the supporting surface near the track. The disks can support a user's hands or feet and the components can be arranged in various combinations for different exercises.

An improved device of that kind is shown in applicant's co-pending application Ser. No. 10/087,079, filed Mar. 1, 2002, entitled "Exercise Device," and disclosing a compact and portable device that uses two box-like platforms, one with wheels, for a variety of exercises that involve reciprocating or spreading movement of the two platforms. Optional additions to these platforms, closely related to aspects of the present invention, are two disk assemblies that are mountable on the platforms to add rotational movement to the reciprocating movement of the two platforms. These disks may be used in a completely free mode of "open chain" operation, or may be connected by elastic resistance bands for "closed chain" operation.

SUMMARY OF THE PRESENT INVENTION

The present invention resides in a novel exercise device that is of relatively simple and easily transportable construction and that enables the user to perform a large variety of fitness exercises, usually on two rotary disks that are variably positioned on a stationary base. This device is particularly well suited for special full-body rotational exercises that improve coordination, core strength, stability and functional ability, in both closed-chain and open-chain modes of use, and is easily adapted as an extra function to "balance" or "wobble" board exercises as well.

For these purposes, the device of the invention comprises an elongated base platform having a longitudinal series of first mounting elements spaced at predetermined intervals on its upper side, and two rotary disk assemblies with second mounting elements engageable with the first mounting elements to position the disk assemblies in different selected positions on the platform, to set different spans for the user during exercising. Preferably, the platform is an open-sided box with sidewalls that support it above the floor. Resistance bands are provided to extend between connectors on the disk assemblies, and also for connection to anchors on the platform, for closed chain operation, and the platform is divided longitudinally to form a second, substantially identical platform section to serve as an extension of the length of the first platform section and to be placed side-by-side with the first section in a closed position for transporting and storage of the device. The use of two sections makes it possible to limit the length of the device in the closed position while providing for substantial length for advanced exercises in use. In addition, a balance bar is mountable on the underside of one of the platform sections to provide an additional set of combined balancing and rotational exercises. All of the elements are storable inside the platform sections in the closed position, in which the platform sections are latched together.

Other aspects and advantages of the invention will become apparent from the accompanying drawings and the detailed description. In the drawings.

Figure 7:
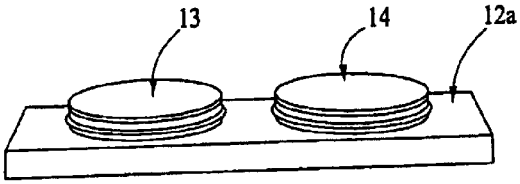
FIG. 7 is a top and side perspective view of one platform section with the balance block installed.
Figure 8:
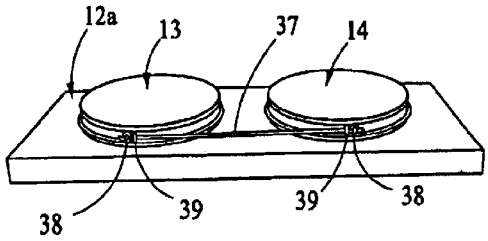
FIG. 8 is a view similar to FIG. 7 with one resistance band installed.
Figure 12A:
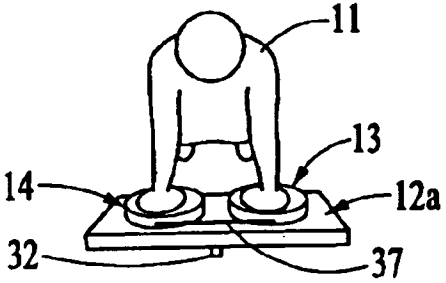
Figure 11A:
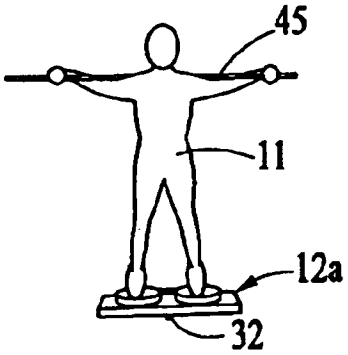
Figure 10A:
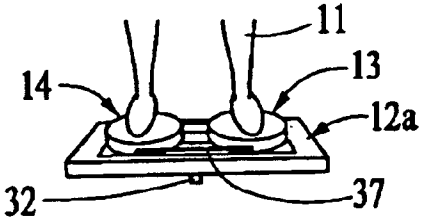

FIGS. 9, A, B and C are diagrammatic top plan views of different combinations of platform sections and resistance bands;

FIGS. 10A and B are schematic views similar to FIG. 8 showing a single platform section with different user positions;

FIGS. 11A and B are schematic views similar to FIG. 7 with different user positions and accessories;

FIGS. 12A and B are views similar to FIGS. 10A and B with still further user positions; and FIGS. 13A through 15C are views similar to views 10A and B showing two platform sections and different user positions, and including in each view an elastic resistance band extending between the user and an anchor such as a wall.

DETAILED DESCRIPTION

As shown in the drawings for purposes of illustration, the invention is embodied in an exercise device, indicated generally by the reference number 10, for use by an individual 11 in performing a variety of different exercises on the device, which typically is placed on a supporting surface such as a floor (not shown) for use. The device generally comprises an elongated base platform 12 (see FIGS. 2 and 9–15) and two rotary disk assemblies 13 and 14 that are positioned on the platform in longitudinally spaced positions to support the user's feet (or hands) during rotational exercises.

In accordance with one feature of the invention, the base platform 12 is divided longitudinally into two sections 12*a* and 12*b* that are substantially the same in size and shape and fit together in end-to-end relation during use and in side-by-side relation in a closed position for transportation and storage. Each platform section has a preferably rectangular top wall 15 forming the top surface of the platform, and narrow sidewalls 17 and end walls 18 that support the top wall over the floor when the device is in use. These sections also cooperate to define an internal compartment for the storage of the other components of the device when in the side-by-side position, used for transporting and storage of the device.

Figure 4:
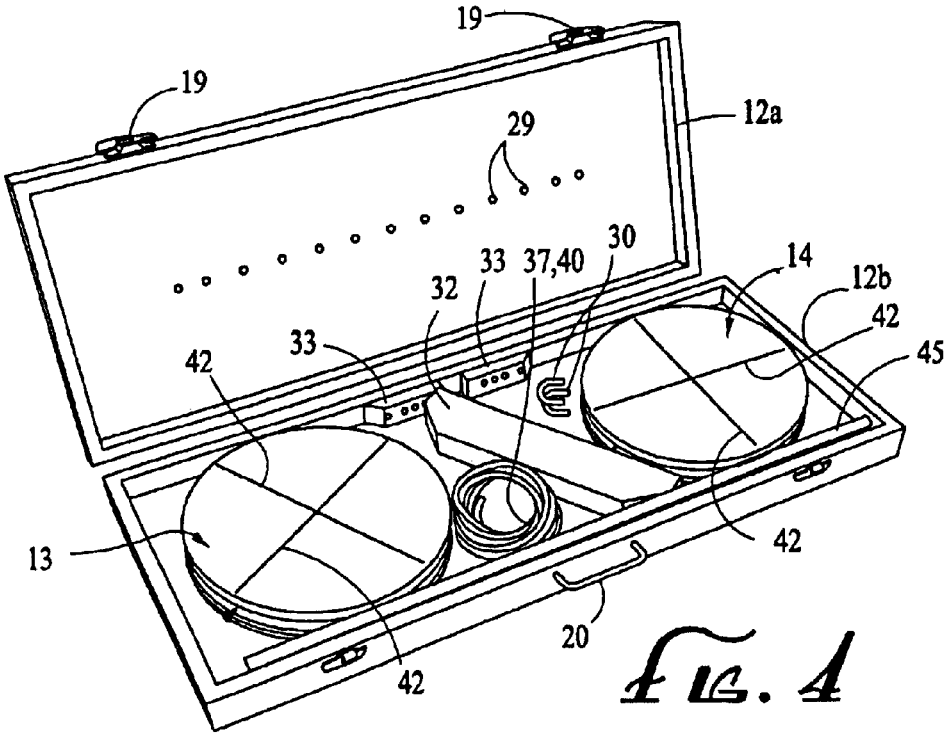
FIG. 4 is a view similar to FIG. 3 with additional components of the device shown in storage positions within one of the platform sections.
Figure 5:
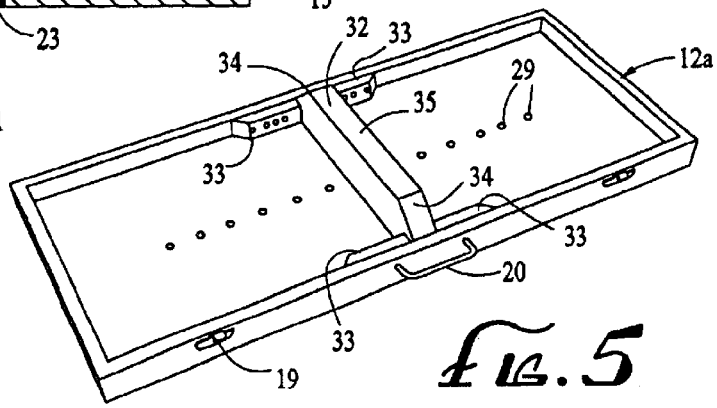
FIG. 5 is a bottom perspective view of one platform section with the balance block installed.
Figure 6:
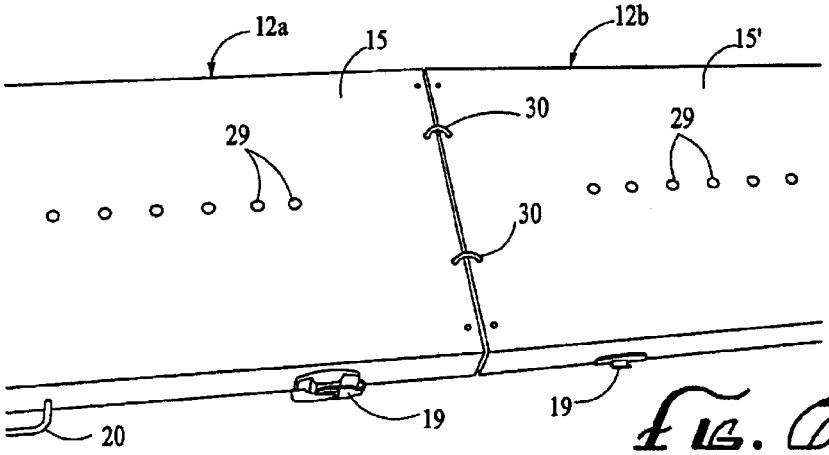
FIG. 6 is an enlarged fragmentary top perspective view of end portions of the platform sections in end-to-end relation and with two connectors in place.

At least one latch 19, and herein two on each side as shown in FIGS. 5 and 4, are provided to hold the platform sections releasably in the closed position, in which the device can be carried with relative ease. A simple U-shaped handle 20 is mounted on the central portion of one side for carrying the device. Various kinds of latches may be used, those shown herein being conventional window sash latches or locks. A typical size of the exercise device is six feet long, overall, formed by two three-foot long box-like sections 12*a* and 12*b* each having approximately two-inch wide sidewalls 17 and end walls 18 and a top wall 15 that is on the order of fifteen inches wide. These dimensions are illustrative only. A suitable material for the platform sections is wood, but other, preferably lightweight, materials may be used.

Figure 4A:
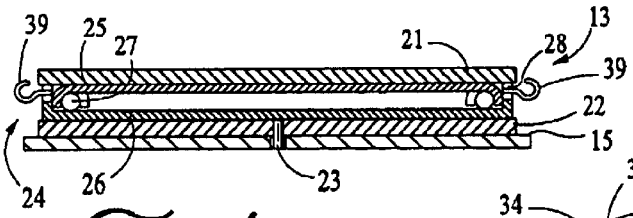
FIG. 4A is an enlarged fragmentary cross-sectional view taken through one of the disk assemblies mounted on the base platform.

The rotary disk assemblies 13 and 14, the construction of which is the same and is shown in detail in FIG. 4A, are sized to support a user's feet or hands and herein are shown as being about twelve inches in diameter, having upper elements 21 that herein are wooden disks, similar lower support elements 22 that also may be wooden disks and have central mounting elements in the form of depending pins 23 on their undersides. Between the two disks 21 and 22 of each assembly is an antifriction bearing 24, this bearing preferably being of the ball-bearing type in which the upper race 25 is supported on the upper disk and a lower race 26 is supported on the lower disk, with a series of ball bearings 27 trapped between the races to support the upper disk for virtually friction free turning. A cylindrical sidewall 28 for the disk assembly is attached as a skirt to the upper disk 21 and covers the outer sides of the antifriction bearing, except for the outer edge of the lower race as shown in FIG. 4.

Another feature of the exercise device 10 is the ability to adjust the positions of the disk assemblies 13 and 14 to a plurality of different discrete positions on the platform sections 12*a* and 12*b* to provide a wide range of fixed spans for the user, thereby varying the difficulty of the exercises to be performed over a wide range. For this purpose, a longitudinal series of mounting elements 29 is provided on the upper surface of each of the platform sections and spaced apart at preselected intervals, such as two inches for each, for cooperation with mounting elements on the disk assemblies (herein the pins 23) in locating the disk assemblies on the platform. The mounting elements 29 on the platform 12 preferably are simple drilled holes that are sized to receive the pins 23 with a fairly close fit. The pins are simply short pieces of wooden dowel (FIG. 4A), with tips that may be tapered for ease of insertion in the holes 29. As shown, there are thirteen mounting holes in each platform section, providing as much as two feet of adjustment on each platform section and a maximum span on the order of five feet with the illustrative embodiment.

Figure 9A:
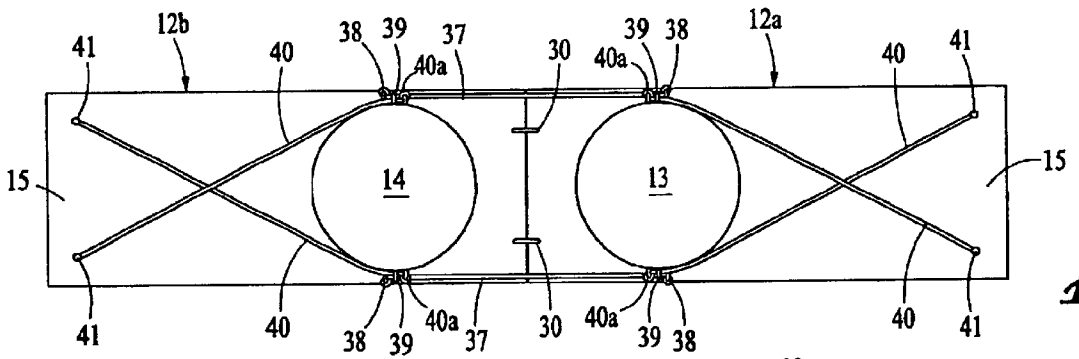
Figure 9B:
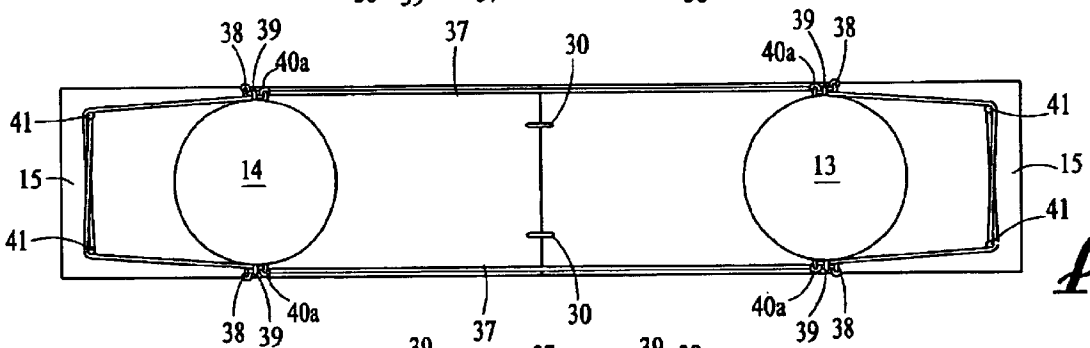
Figure 9C:
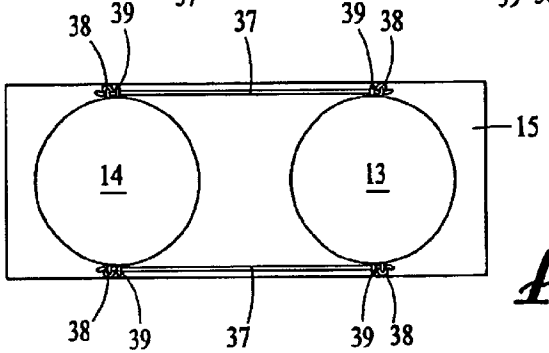

For very short spans, the disk assemblies may be mounted entirely on one platform section, as shown in FIGS. 9C and 10 through 12, and the full platform may be used for both longer spans and short spans with different arrangements of resistance bands, to be described. To hold the two sections of the full platform together, two connectors 30 are provided to join the adjacent ends as shown in FIGS. 2 and 9A and B. These are U-shaped pins having opposite ends fitted snugly in two sets of holes 31 (see FIG. 1) near the adjacent ends of the platform section. They are shown in storage positions in the device 10 in FIG. 4, and preferably will be held in a bag or other small container (not shown) when not in use.

Also shown stored in the exercise device in FIG. 4 is a balance bar 32, sometimes called a "wobble bar," for use in converting one of the platform sections 12*a* into a balance board for the additional exercise benefits achieved with such boards. The illustrative balance bar is a short "2×4" board sized to fit between the two sidewalls 17 of the platform section 12*a*, as shown in FIG. 5, with its ends in sockets defined between two blocks 33 fastened to each sidewall, and with short bevels 34 at its ends. The flat underside 35 of the balance bar is positioned well beneath the edges of the sidewalls 17 to form a fulcrum for the platform section 12*a*.

Also stored in the device 10 as shown in FIG. 4 is a group of elongated resistance bands that may be attached to the rotary disks 21 in various ways, and also to the platform 12, to cause the disks to turn together in a closed-chain mode and to provide resistance to turning of the disks. An illustrative group includes two short bands 37, each with two knotted ends 38 to be stretched between connectors 39 such as screw hooks secured to diametrically opposite sides of the rotary disks 21, and four long bands 40 each with one knotted end 40*a* to form a connector for releasable attachment to the disks, and an additional connector at its opposite end for releasable connection to the platform 12. Herein, the additional connectors are pins 41 that are secured to the unknotted ends of the bands 40 and are sized to fit snugly into holes 43 (FIG. 1) drilled in each of the platform sections near its corners. The relaxed lengths of the bands are less than the distances between the various connectors so that the bands are under some tension when the disks are in their starting positions, as shown in FIGS. 8 and 9A–C.

As shown in FIG. 4, the top surfaces of the rotary disk elements 21 preferably are marked with lines 42 on two intersecting diameters, one extending between the two screw-hook connectors 39, to provide visual indicators for the starting positions of the disks and for the amount of turning during exercises. Visual indicator lines 44 (FIG. 1) also may be provided on the top surfaces of the platform sections, extending transversely through the holes 29 for quick reference as to the amount of separation of the disk assemblies.

With reference to FIGS. 7 through 9, various combinations of resistance and resistance-band attachments are shown, beginning in FIG. 7 with no bands attached and both disk assemblies 13 and 14 in closely spaced relation on one of the platform sections. This illustrates the open-chain mode of exercising, which is the most demanding because the user must control the rotation of each disk individually. In FIG. 8, a single band 37 is stretched between two hook connectors 39 on corresponding sides of the disk assemblies, which is a common low-resistance mode. A double-band variation is shown in FIG. 9.

FIGS. 9A and 9B show the full two-section platform 12, joined by the U-shaped connectors 30 and with different arrangements of multiple resistance bands for different loading of the disks 21. In FIG. 9A, the two short bands 37 are connected between opposite sides of the disks with knotted ends caught in the connectors 39 and the four longer bands 40 held in the hook connectors 39 by knotted ends and are crossed and pinned at the corners, the pins 41 being set in the holes 43 near the corners. In FIG. 9B, the disk assemblies are spaced apart for a large span (such as can be seen in FIG. 14) and two long bands 40 are stretched from knotted ends 40*a* at the connectors 39 around the pin of the other long band 44 at the corner and pinned at the other corner to provide the desired tension. Each long band thus extends from a screw hook 39 to the corner, bends around the pin 41 of the other long band, and extends to the other corner where its own pin 41 is set Other combinations are possible, for differing resistance to turning, using the connectors that are provided and various resistance band lengths.

General considerations in use of the device 10 in these exercises are care in establishing range of motion and loading, using lighter loads and shorter ranges before progressing; care in establishing and maintaining the proper postures, preferably under direction of a skilled trainer, including perineal contraction (belly button in and up, tail bone down) and lifting the chest while pulling the shoulders down and back; and proper breathing rate and rhythm. It is recommended that the user's eyes should be fixed on a relevant point or points in space, generally in a direction at ninety degrees to the line of the spine or the horizon. Individual detailed directions should be provided for each exercise.

Figure 11B:
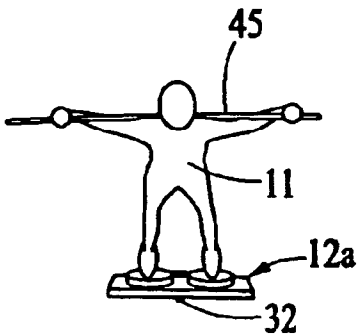
Figure 10B:
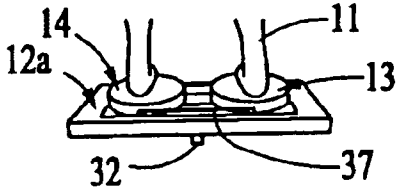

In the diagrammatic sequence views shown in FIGS. 10 through 15, FIG. 10 shows a simple double-disk configuration on one platform section 12*a* with a single resistance band 37, and with the optional balance board 32 in place, and FIG. 10B shows a reverse position of the user. FIG. 11 shows a "disk squat" exercise, using an accessory pole 45 that holds the user's arms in the extended positions shown, again with the balance board in place and one resistance band 37 connected between the disks. The squat exercise shown is combined with rotational movements on the disks, while balancing on the platform section 12*a*.

Figure 12B:
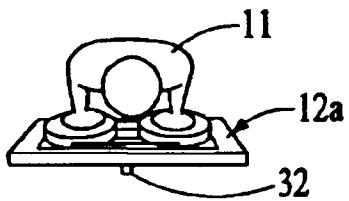

In FIG. 12, the exercise device is set up as in FIG. 10 with one resistance band 37 and the user is in a "push up" position with hands on the disks and feet on the floor. Rotational movements of the disks thus can be incorporated in the push ups.

Figure 13A:
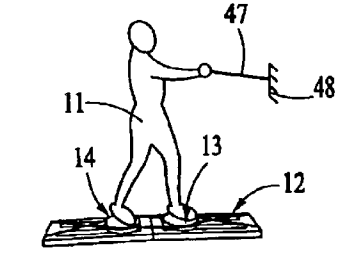
Figure 13B:
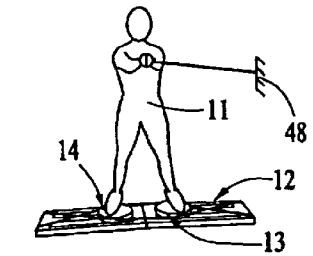
Figure 13C:
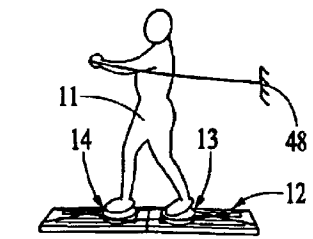
Figure 14A:
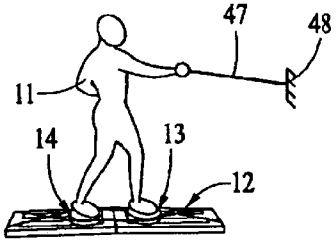
Figure 14B:
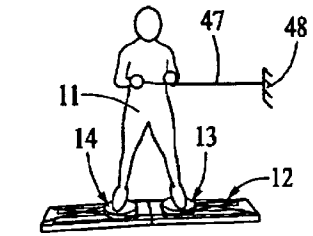
Figure 14C:
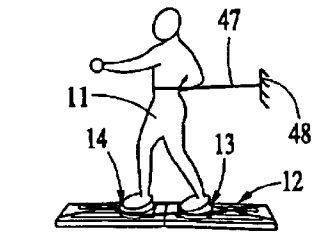
Figure 15A:
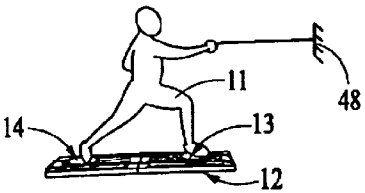

The full base platform 12 is used in the exercises shown in FIGS. 13, 14 and 15. FIG. 13 shows a "basic rotation with resistance" exercise on closely spaced disks with the bands arranged as in FIG. 9A. This begins in a turned position of the user who is rotated to the right (as viewed in FIG. 13) and is gripping in both hands a resistance band 47 that is attached to an external anchor 48 such as a wall. From this position, the user rotates to the front (FIG. 13B) and then continues to the left (FIG. 13C), after which he or she rotates back to the starting position. This sequence can be repeated as desired.

In FIG. 14, the sequence illustrated is a "reach and rotate" exercise on closely spaced disk assemblies with the bands in the same arrangement as in FIG. 13. This also begins in a turned position with the band 47 gripped in the user's right hand (on the right side in FIG. 14A), from which the user rotates to the left away from the wall anchor 48, and then rotates fully to the left while retracting the right hand and extending the free left hand, as shown. Again, the user will reverse and repeat this sequence a selected number of times.

Figure 15B:
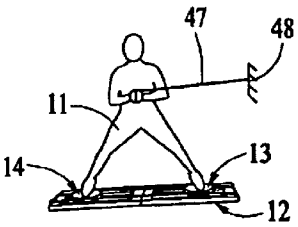
Figure 15C:
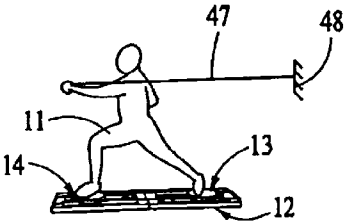

The disk assemblies 13 and 14 are shown in FIG. 15 as widely separated to provide a wide span for a very challenging workout in an exercise referred to as "reach, pull, push away". This begins in the same position as the exercise in FIG. 14, then proceeds with rotation away from the wall anchor 48 through the position in FIG. 15B and a one hundred-eighty degree turn to the left while the user pulls the band and rotates to the extended position shown in FIG. 14C. This also is reversed and repeated, as desired.

Figure 1:
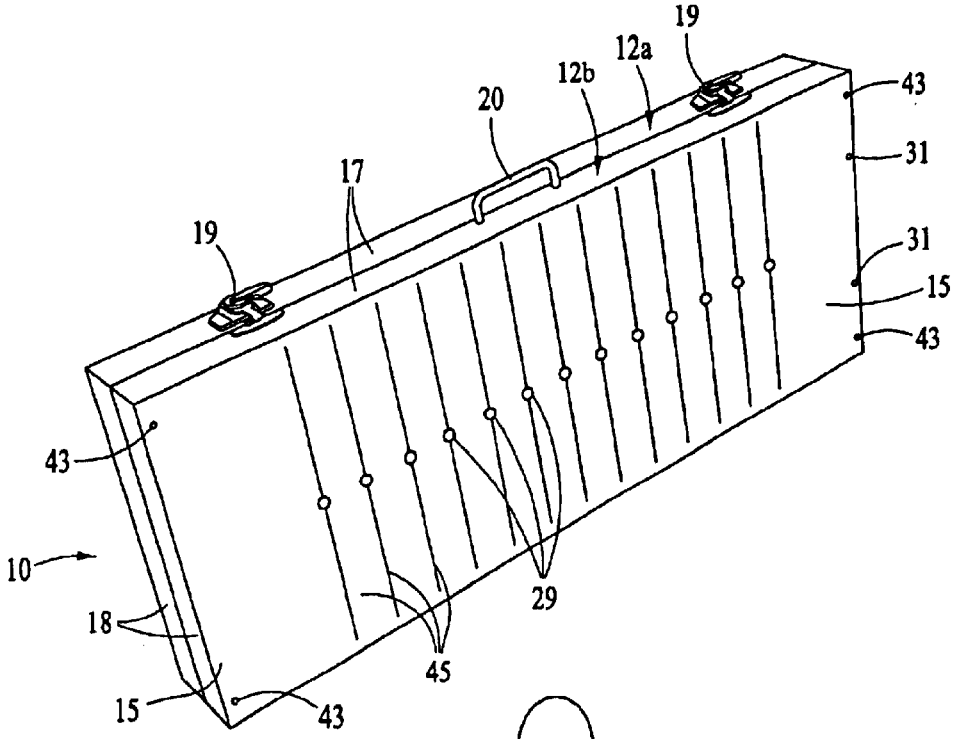
FIG. 1 is a perspective view of an exercise device in accordance with the present invention in the closed position for transportation and storage.
Figure 2:
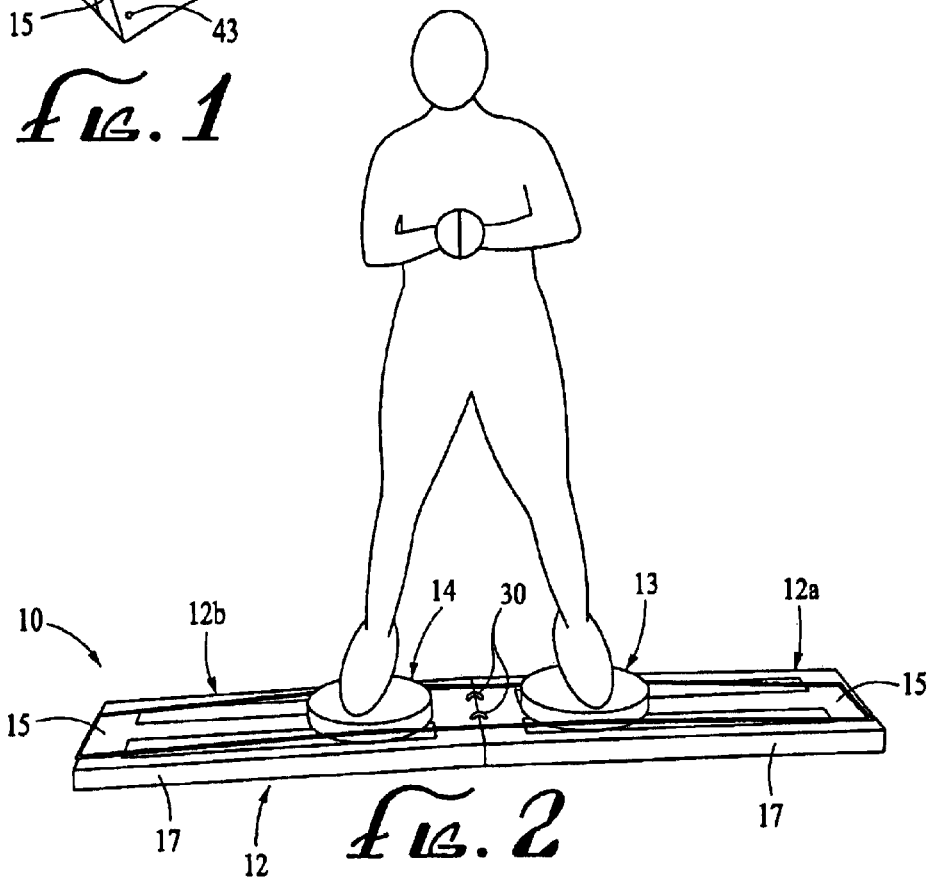
FIG. 2 is a somewhat diagrammatic perspective view of the device of FIG. 1 on a reduced scale and shown in the open, exercise position with a user shown in outline form and without details of the resistance bands.
Figure 3:
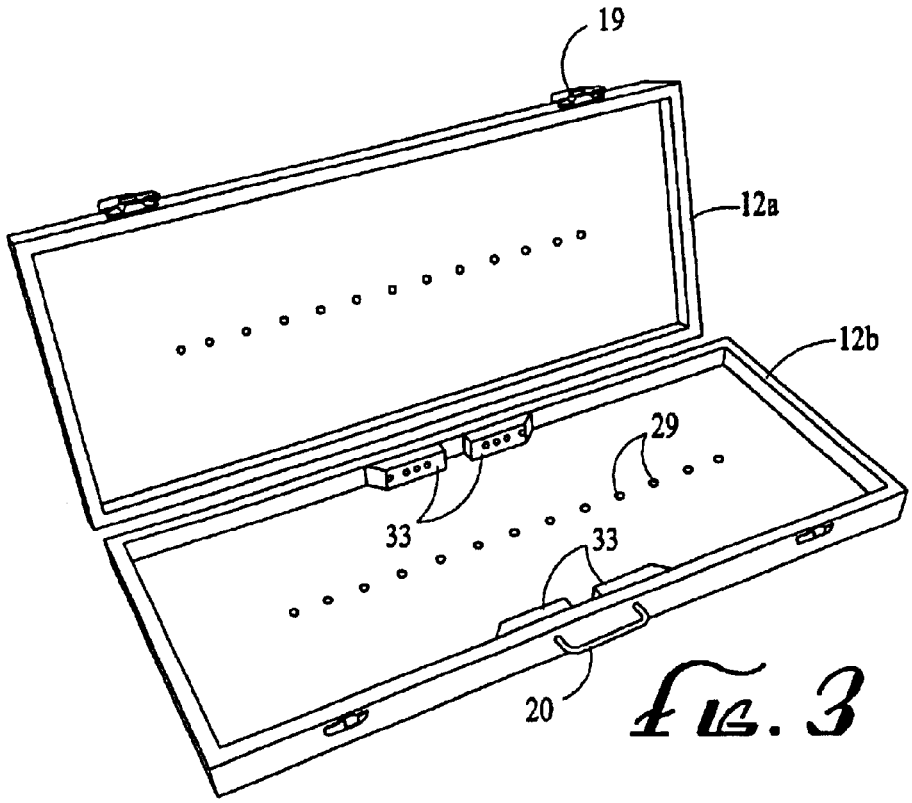
FIG. 3 is a perspective view of the device of FIG. 1 showing only the two platform sections in a partially open position.

Many other exercises may be performed on the exercise device 10 of the present invention, which is self-contained and neatly and compactly packed for storage in the close position shown in FIG. 1, and is usable in a variety of different forms, positions and combinations as illustrated herein. The various exercises can be designed to increase and enhance the user's core strength, stability, functional ability and overall posture, and are particularly effective in challenging the user's perineal area and proprioceptive system, demanding greater neuromuscular output than traditional exercise equipment and techniques. In particular, the rotational movements effectively isolate the transverse plane and improve the user's reaction time, response selection, visual field and rotational-movement chain, from the feet up through the entire body. The closed-chain mode of operation and fixed close disk positions provide education and safety advantages for a less-developed user, and the open-chain and fixed wider-spans of use are capable of challenging even the well-conditioned athlete.

From the foregoing, it will be apparent that the present invention provides a novel and versatile exercise device for the purposes that have been described. It also will be apparent that one presently preferred embodiment has been illustrated and described, and that various modifications and changes may be made by those skilled in the art within the spirit and scope of the invention.

I claim as my invention:

1. An exercise device having, in combination:

an elongated, two-piece base platform adapted to be placed on a flat supporting surface and comprising two elongated, generally rectangular and substantially similar box-like platform sections each having a closed upper side and narrow sidewalls and end walls having edges for engaging the supporting surface, said sidewalls and end walls defining an open lower side of each platform section;

said platform sections being positionable in end-to-end relation to form an elongated base platform and being positionable with said edges together in a closed position for transporting and storing the exercise device;

releasable base connectors for joining said platform sections together in end-to-end relation comprising U-shaped connecting pins, said base sections having two sets of holes for receiving ends of the base connectors with the latter straddling the adjacent end walls of the base sections;

two rotary disk assemblies each having an upper disk element sized to support a user's foot, or hand, a lower disk element mountable on one of the platform sections, and a bearing between said elements rotatably supporting the upper disk element on the lower disk element;

each of said platform sections having a longitudinal series of spaced mounting holes in the central portion of the upper side thereof and each of said lower disk elements having a lower side and a depending mounting pin on the lower side engageable in a selected one of said mounting holes to position the disk assembly on the platform section;

and selectively engageable and releasable latches on said platform sections for holding them releasably in the closed position, and a carrying handle on one of said sidewalls, said disk assemblies being sized to fit within the exercise device in said closed position with said mounting pins reversely engaged in selected mounting holds in said upper sides.

2. An exercise device having, in combination:

an elongated, two-piece base platform adapted to be placed on a flat supporting surface and comprising two elongated, generally rectangular and substantially similar box-like platform sections each having a closed upper side and narrow sidewalls and end walls having edges for engaging the supporting surface, said sidewalls and end walls defining an open lower side of each platform section;

said platform sections being positionable in end-to-end relation to form an elongated base platform and being positionable with said edges together in a closed position for transporting and storing the exercise device;

two rotary disk assemblies each having an upper disk element sized to support a user's foot, or hand, a lower disk element mountable on one of the platform sections, and a bearing between said elements rotatably supporting the upper disk element on the lower disk element;

each of said platform sections having a longitudinal series of spaced mounting holes in the central portion of the upper side thereof and each of said lower disk elements having a lower side and a depending mounting pin on the lower side engageable in a selected one of said mounting holes to position the disk assembly on the platform section;

a balance bar mountable in a transverse position on one of said platform sections to extend between the sidewalls thereof, said balance bar having a lower side disposed beneath the side edges of said one of the platform sections to form a balancing fulcrum for the platform section and having a length less than the transverse spacing of said sidewalls and said sidewalls are formed with sockets on their inner sides for receiving the ends of the balance bar, and wherein each of the sockets is formed by the adjacent sides of a pair of spaced blocks fastened to the inner sides of the sidewalls.

3. An exercise device having, in combination:

an elongated platform adapted to be placed on a supporting surface and having an upper side;

two rotary disk assemblies each having an upper rotary disk element sized to support a user's body a longitudinal series of spaced first mounting elements on said upper side and spaced apart thereon at preselected intervals;

a second mounting element on each of said disk assemblies that is engageable with a selected one of first mounting elements and operable, when engaged, to hold the associated disk assembly rotatably in a selected discrete exercise position on said platform;

wherein each of said rotary disk elements has first connectors on diametrically opposite sides, and said platform has second connectors adjacent its opposite longitudinal ends;

and further including second elastic resistance elements extending between and releasably secured to said first and second connectors;

said disk assemblies being movable to different positions on said platform to vary the spacing of the rotary disk elements during exercise.

4. An exercise device as defined in claim 3 wherein said second connectors include pinholes adjacent the ends of said platform and pins attached to said second resistance elements and sized to be received releasably in said pinholes.

5. An exercise device having, in combination:

an elongated platform adapted to be placed on a supporting surface and having an upper side;

two rotary disk assemblies each having an upper rotary disk element sized to support a user's body;

a longitudinal two mounting elements on said upper side spaced apart by a preselected interval;

a second mounting element on each of said disk assemblies that is engageable with one of said first mounting elements and operable, when engaged, to hold the associated disk assembly rotatably in a discrete exercise position on said platform;

said disk assemblies being rotatable on said platform while weight of a user is supported by the disk assemblies;

wherein each of said rotary disk elements has first connectors on diametrically opposite sides, and said platform has second connectors adjacent its opposite longitudinal ends, and further including second elastic resistance elements extending between and releasably secured to said first and second connectors.

6. An exercise device as defined in claim 5 wherein said second connectors include pinholes adjacent the ends of said platform and pins attached to said second resistance elements and sized to be received releasably in said pinholes.

* * * * *